US005820788A

United States Patent [19]

Smith

[11] Patent Number: 5,820,788

[45] Date of Patent: Oct. 13, 1998

[54] ELECTROCONDUCTIVE ANTISTATIC POLYMERS CONTAINING CARBONACEOUS FIBERS

[75] Inventor: W. Novis Smith, Philadelphia, Pa.

[73] Assignee: SGL Technic Ltd., Ross-Shire, Scotland

[21] Appl. No.: 789,400

[22] Filed: Jan. 29, 1997

[51] Int. Cl.[6] ..... H01B 1/24

[52] U.S. Cl. ..... 252/511; 264/105; 524/496; 423/447.2

[58] Field of Search ..... 252/511; 264/105; 524/495, 496; 423/447.2, 447.9

[56] References Cited

U.S. PATENT DOCUMENTS 4,795,592 1/1989 Lander et al. ..... 252/511
4,837,076 6/1989 McCullough, Jr. et al. ..... 428/224
5,068,061 11/1991 Knobel et al. ..... 252/511
5,098,610 3/1992 Okamura et al. ..... 252/511

*Primary Examiner*—Mark Kopec
*Attorney, Agent, or Firm*—John Lezdey & Associates

[57] ABSTRACT

The present invention relates to antistatic polymers containing a mixture of a thermoplastic resin and about 8–20% by weight of conductive partially carbonized chopped linear carbonaceous fibers. The chopped carbonaceous fibers have a carbon content of about 70–85% by weight and an electrical resistivity of about $10^{-2-103}$ ohm-cm. The composite has a surface resistivity of about $10^{4}$–$10^{10}$ ohms/square. These intermediate surface resistivities make the composite an excellent choice for use with plastic parts that come into direct contact with electronic components and circuitry.

11 Claims, 1 Drawing Sheet

ELECTROCONDUCTIVE ANTISTATIC POLYMERS CONTAINING CARBONACEOUS FIBERS

BACKGROUND OF THE INVENTION

1. Field of the Invention

The present invention relates to a polymer composite containing partially carbonized chopped linear carbonaceous fibers for controlling static in electronic circuitry applications.

2. Description of the Prior Art

Static electricity is estimated to cost industry billions of dollars annually from damaged semiconductors and printed circuit boards. A support industry has developed that provides conductive, static shielding and antistatic materials for electronics packaging and materials handling. Static control plastics include, for example, fiber, chemical or particle filled thermoplastics which are fabricated into films, bags, tote boxes, module carriers, chip carriers, dip tubes, wafer holders, and the like.

Requirements for static control can vary. Generally, composites having electrical surface resistivities less than $10^{12}$ ohms/square are suitable and below $10^{10}$ ohms/square are ideal. A further advantage in some cases would include the incorporation of a Faraday Shield which is a conductive layer or grid that reduces exposure of packaged electronic components to electrostatic "fields" as opposed to "discharges".

Heretofore, the art in static control has, primarily, consisted of two separate and distinct technologies, which cannot be advantageously combined. The first conventional technology involves surface active systems including amine blooming agents, humectants and surfactants. These systems perform by absorbing ambient moisture at the polymer structure surface forming an aqueous electrolyte microlayer capable of conducting, dissipating and/or attenuating electric charge along the structure's surface. Structures like these have no volume conductivity properties.

The second conventional technology in static control involves the incorporation of conductive fillers. It is common to incorporate fillers like fibers, particles, and flakes into thermoplastic resins for reinforcement or modification of the resin's bulk mechanical properties. An electrically conductive thermoplastic material is a resin that has been modified with electrically conductive additives such as powdered carbon black, carbon fibers, metal fibers, metal-coated carbon fibers and metal powders. These electrically conductive fibers can similarly be incorporated into thermoplastic resins to lend bulk conductive properties to the resin.

In the use of conductive carbon fibers, metal flakes, metal-coated fibers and metal fibers, the additive levels must be high enough to assure particle to particle contact in the resin. For example, in the case where conductive fillers are used in a resin, the critical factor is loading, that is, it is required that the conductive particles or fibers touch, or very nearly touch each other to establish electrical continuity throughout the plastic structure. The resulting conductivity is primarily a function of the intrinsic conductivity of the conductive additive or filler and the loading level. For example, when using carbon black as a filler, depending on the particle surface area, particle diameter and blending parameters, the required loadings usually exceed 20 weight % and often range as high as 40 weight %. Such high loadings of carbon particles result in compromised physical properties such as a darkened, blackened, opaque material that can potentially slough carbon particles. Sloughing is a source of contamination of much concern in the electronics industry. Therefore, particle to particle contact is critical to producing a good product.

Conventional graphite or carbon fibers, due to their high dimensional aspect ratio (length to diameter, 1/d), can be added to significantly lower the necessary weight levels and still give satisfactory conductive properties to thermoplastics. Again, the magnitude of conductivity achieved depends on loading, fiber shape and size, compounding parameters, and the intrinsic conductivity or resistivity of the fibers.

Typically, conventional conductive fiber loadings as low as 8–20 weight % have been used. The critical factor is the fiber length. For example, longer fibers are more likely than shorter fibers to touch and complete the electrical circuit. However, in the past the retention of fiber length during processing of the composition has been a key problem. Shear forces in processing equipment break the fibers (estimated to be in the 1–3 mm range), shortening their effective dimensional aspect ratio and reducing their usefulness. To compensate, an increased amount of fiber is added to the resin contributing to material cost increases, polymer structure stiffening and opacity.

U.S. Pat. No. 4,602,051 to Nabeta et al., which is herein incorporated by reference, discloses a resin composition with conventional carbon fibers which has an electromagnetic wave shielding effect. There is further disclosed a kneading and extrusion process which may be utilized in the present invention.

U.S. Pat. No. 4,678,699 to Kritchevsky et al., which is herein incorporated by reference, relates to stampable thermoplastic composites containing a shielding layer against electromagnetic and radio frequency waves. Further disclosed are fibrous conductive filler materials which may also be used in the present invention.

The article entitled "EMI Shielding Through Conductive Plastics" by Simon, R. M., Polym. Plast. Technol. Eng., 17(1). 1–10 (1981), which is herewith incorporated by reference, discloses conductive plastics which can be utilized in the present invention.

U.S. Pat. No. 5,068,061 to Knobel et al., which is herein incorporated by reference, discloses resilient shaped curly non-linear carbonaceous fibers used in combination with a resin to form a conductive composite having an electrical surface resistivity of $10^{10}$–$10^{12}$ ohms/square.

The present invention teaches an improved approach to achieving the required conductivities for plastics used in the handling, mounting and containing of electronic circuit chips, electronic components and other electrical applications. These plastics must be made antistatic and conductive. But, they must not be too conductive in order to eliminate sparking and maintain maximum protection of the microchips, electronic circuits, electrical components, and the like.

It is therefore desired to provide a novel composition that when prepared by conventional processing equipment, eliminates or ameliorates many of the problems associated with the prior art fibers and processes for producing the composition.

It is further desired to provide novel static control materials and structures with the following advantages over the prior art materials and structures.

It is further desired to provide novel static control materials and structures with surfaces having controlled surface resistivities in the range of $10^{4}$–$10^{11}$ ohms/square without the need to use difficult to handle fine conductive particles at structure surfaces where there are potential contaminants, and which also must be used at higher addition levels of over 14% by weight.

It is further desired to provide novel static control materials and structures with surfaces having controlled surface resistivities in the range of $10^4$–$10^{11}$ ohms/square using chopped carbon fiber at 8–14% by weight and eliminating off specification material and waste.

It is further desired to provide novel static control materials and structures with thick rigid thermoplastic sheets which can be readily drawn-down without significant loss of conductivity at edges and in corners.

It is further desired to provide novel static control materials and structures with surface electrical properties which are easily achieved with chopped fiber.

It is further desired to provide novel static control materials and structures which may be washed with no effect on electrical properties.

It is further desired to provide novel static control materials and structures which allow the fibers to be handled cleanly with minimum waste, high reproducability, and high line speed.

The term "carbonaceous" used herein refers to carbonaceous materials which have a carbon content of at least 65% and up to 90% and which may be prepared by various methods including the method described in U.S. Pat. No. 4,837,076 to McCullough et al., which is herein incorporated by reference.

SUMMARY OF THE INVENTION

The present invention discloses an application and composition whereby high electrically resistive carbonaceous fibers derived from polyacrylonitrile (hereinafter "PAN") precursors or pitch fibers are used to achieve intermediate electrical surface and volume resistivities with resins, particularly thermoplastics. Currently, chopped carbon fibers which are generally about 6 mm in length are added to thermoplastic resins such as polycarbonate, polyamides, polyphenylenesulfide, and the like, to impart antistatic and impact properties. These fibers have an electrical resistivity of about $10^{-3}$ ohm-cm. They are usually added in the amounts of 10–30% by weight depending on how much is needed to achieve a controlled surface resistivity in the composite of less than $10^{11}$ ohms/square which is the maximum resistance level for achieving standard static dissipation. For thermoplastic parts used in the computer and general electronics areas, the antistatic aspects are very important. Normally, 10–16% by weight of a fully conductive carbon fiber (about $10^{-3}$ ohm-cm) is added to the resin molding compound for standard antistatic plastic parts.

More particularly, the present invention provides a composite for controlling static electricity in processing holders for chips, wafers, electronic circuitry parts, and the like. The novel composite includes the combination of a thermoplastic resin and about 8–18% by weight of conductive partially carbonized chopped linear carbonaceous fibers. The carbonaceous fibers have been partially carbonized to a range of 70–85% by weight in carbon content and are not as conductive as standard carbon fiber materials. Standard carbon fibers usually have 92–99% by weight in carbon content and have electrical resistivities of about $10^{-3}$ ohm-cm. The partially carbonized carbonaceous fibers used in this invention have electrical resistivities of about $10^{-2}$–$10^3$ ohm-cm. Unexpectedly, these fibers are best used in chopped form at about 3–6 mm in length and respond in the same way as standard carbon fibers (92+% by weight in carbon content) except that the surface resistivity in the composite levels off at levels above $10^4$–$10^{10}$ ohm/square depending on the level of carbonization of the partially carbonized fibers.

These fibers can also be used in milled and continuous forms. Furthermore, they are also usually sized for the plastic in which they are being used. The total surface resistivity for the composite taught by the present invention ranges from about $10^4$–$10^{10}$ ohms/square.

Currently, intermediate surface resistivities of $10^4$–$10^{10}$ ohms-cm are achieved by two different methods:

1) carefully adding standard chopped carbon fiber (92+% by weight in carbon content) that is 3–6 mm length to an extruder at 9–12% by weight levels. The amount added determines the final surface resistivity, but the response curve to weight is so steep that frequently too much or too little is added which results in going outside the desired range. This produces waste or the necessity to reblend the compounded product resin pellets.

2) adding standard milled carbon fiber (92+% by weight in carbon content) that is 0.1–0.2 mm in length in amounts of about 14–18% by weight depending on the precise surface resistivity desired. The response curve for surface resistivity with the milled fibers is more gradual than it is for the chopped fibers and therefore, more careful control of the final surface resistivity in the compounded pellet product is achieved with lower waste. However, there are two major disadvantages to the milled fiber method: it requires the addition of up to 50% by weight more carbon fiber, and milled fibers are dusty, and thus difficult to handle.

It would be advantageous to be able to add about the same amount of chopped carbon fiber that is 3–6 mm in length and readily achieve the intermediate range of $10^4$–$10^{10}$ ohms/square with minimum waste. The present invention accomplishes this by using chopped carbon fiber with resistivities in the range $10^{-2}$–$10^3$ ohms-cm.

Mixtures of standard conductive carbon fibers (92+% by weight in carbon content) of up to 9% by weight with as little as 2% by weight of partially carbonized fibers can be used to achieve similar results. These composites achieve higher levels of physical properties as compared with using only partially carbonized conductive fibers in the $10^{-2}$–$10^3$ ohm-cm resistivity range. This occurs because the conductive carbon fibers are not present in high enough concentration (usually 11% or more) to accomplish total contact with each other and thus, the 2+% by weight of partially carbonized fibers are necessary to complete the "circuit", but at a higher resistivity than if all of the 92+% by weight of carbon fibers was used.

The advantages and objects of the present invention will become evident by referring to the following description and claims taken in conjunction with the accompanying drawing.

DETAILED DESCRIPTION OF THE PREFERRED EMBODIMENTS

Figure 1:
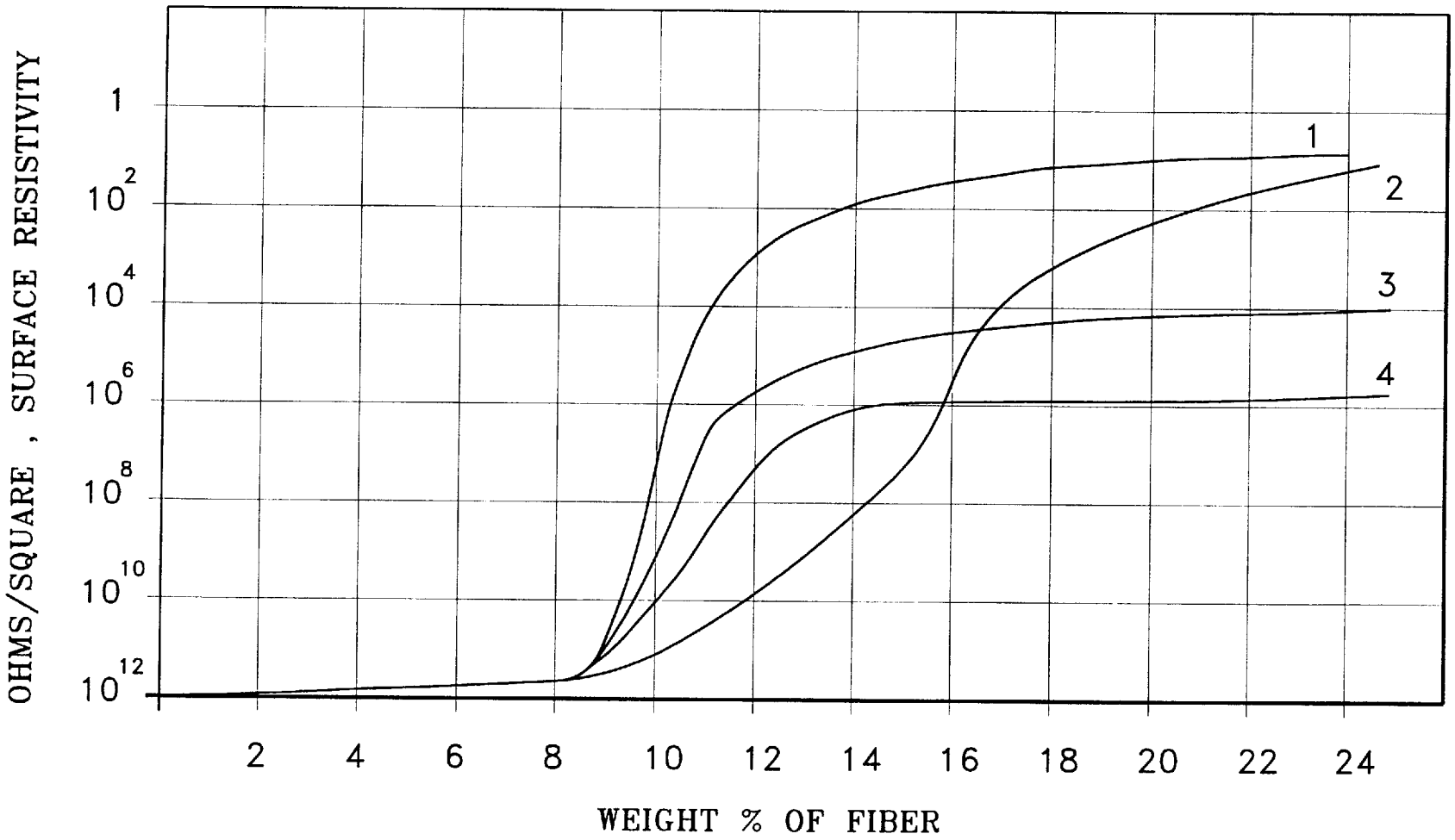
FIG. 1 is a curve showing the surface resistivity of a composite against the addition of various amounts of different types of fibers—carbon and carbonaceous fibers in milled or chopped forms.

The composites taught by the present invention have surface electrical resistivities of about $10^4$–$10^{10}$ ohms/square. Composites having such intermediate surface resistivities are excellent for use with plastic parts that come into direct contact with electronic components such as those used in the processing of microchips, semiconductors and printed circuit boards. The thermoplastic composite cannot have high conductivity. Intermediate conductivity is necessary because too much conductivity can result in fast static discharges or arcing from the plastic part which may damage the chip part or electrical component held by it by way of polarization, heating, or shorting out by contact with the conductive materials. Nor can the composite have too little conductivity because there must be enough conductivity to control and limit the buildup and dissipation of static charges. Surface resistivities in the range of $10^4$–$10^{10}$ ohms/square provide the happy medium to meet the aforementioned requirements.

This intermediate surface resistivity is currently achieved by the very careful addition of limited amounts of chopped carbon fibers having an electrical surface resistivity of about $10^{-3}$ ohm-cm, or alteratively, by the use of larger amounts of milled carbon fibers having the same resistivity. When chopped carbon fiber is used, the change in surface resistivity is very rapid with respect to the amount of carbon fiber added in the desired $10^4$–$10^{10}$ ohms/square region for surface resistivity, which makes it very difficult to add exactly the right amount of carbon fiber without overshooting the desired region.

Referring to the curve in FIG. 1, it shows the typical type of responses seen for various carbon weight percentages of fiber loadings. FIG. 1 contains the following four curves:

Curve 1—Carbon fiber (94% carbon), chopped 6 mm, resisitivity $10^{-3}$ ohm-cm Curve 2—Carbon fiber (94% carbon), milled, 0.1 mm, resistivity $10^{-3}$ ohm-cm Curve 3—Carbonaceous fiber (82% carbon), chopped 6 mm, (a partially carbonized PAN fiber sold under the Trademark PYON®), resistivity $10^{-2}$ ohm-cm Curve 4—Carbonaceous fiber (74% carbon), chopped 6 mm, (a partially carbonized PAN fiber sold under the Trademark PYON®), resistivity $10^1$ ohm-cm Note: Carbonaceous fiber is a partially carbonized fiber whose carbon content has been increased (usually through the application of heat) and which has a carbon content of greater than 65% by weight.

Note that Pyon® 16 and Pyon® 18 are registered trademarks of RK Carbon Fibres, Ltd.

When the target surface resistivity is approached during a blending/extrusion operation, lower amounts of carbon fiber having a resistivity of about $10^{-3}$ ohm-cm are added in order to finely adjust the plastic composite to intermediate higher surface resistivities. However, it is very difficult to add just the right amount of fiber since the resistivity of the resin changes very rapidly in the desired range of $10^4$–$\mathbf{10}^{10}$ ohms/square in response to only small incremental additions of the chopped carbon fiber. In fact, the resistivity remains high until about 10–12% by weight of chopped carbon or carbonaceous fiber has been added, then decreases rapidly and finally levels off again at about 15% by weight addition of fiber. This problem causes a lot of waste and the need for the plastic to be reworked.

The preferred current approach to achieving electrical surface resistivities in the intermediate antistatic range of $10^4$–$10^{10}$ ohms/square is to add milled rather than chopped carbon fiber. Milled carbon fiber has a length of about 0.1–0.2 mm. Consequently, it takes more of the milled carbon fiber to effect a change in surface resistivity. As the milled carbon fiber is added to the plastic, the surface resistivity changes more gradually. Therefore, milled carbon fiber makes it easier to more accurately achieve the desired intermediate ranges of surface conductivity at the expense of requiring higher weight additions of fiber.

Curve 2 in FIG. 1 shows the response of the surface resistivity to the addition level of the milled carbon fiber. This will vary somewhat depending on the type of plastic used and the conditions of compounding the antistatic plastic pellets. There are several problems in using the milled carbon fiber approach. The disadvantages of using milled carbon fiber include that it is very dusty and difficult to handle in production. It also has a greater tendency to cause electrical shorts in the controls of the operating equipment for making the antistatic plastic composites. Furthermore, the use of milled carbon fiber requires greater loadings, usually in the range of 1–18% by weight.

The present invention teaches a composite containing partially carbonized carbonaceous fibers for controlling static charges in components associated with electronic circuitry and the like. The composite comprises the combination of a thermoplastic resin and about 8–20% by weight of conductive partially carbonized chopped linear carbonaceous fibers. The chopped carbonaceous fibers have a carbon content of about 70–85% by weight and an electrical resistivity of about $10^{-2}$–$10^3$ ohm-cm. Preferably, the carbon content of the chopped carbonaceous fibers is about 74–85% by weight. The composite has a surface resistivity of about $10^4$–$10^{10}$ ohms/square. Preferably, the surface resistivity comprises about $10^4$–$10^9$ ohm/square. Curves 3 and 4 in FIG. 1 illustrate the efficacy of the present invention.

The composite unexpectedly provides controlled intermediate surface resistivities with chopped fibers at lower loadings and with superior properties over the milled fiber that is currently used in industry. When the partially carbonized fibers are added to the thermoplastic matrix, the decrease in the surface resistivity occurs at about 10–12% by weight loadings as it also does in the case of fully carbonized fibers. However, with the partially carbonized fibers, the decrease levels off in the intermediate resistivity range which greatly reduces the risk of overshooting the range and making the surface resistivity too low. Therefore, it is much easier to add the partially carbonized fibers to achieve the intermediate resistivity than it is to add the very conductive carbon fibers because the latter require precision addition to avoid too low surface resistivity or too much conductivity. This improvement will eliminate waste and out of specification materials.

The advantages of the present invention over the prior art is graphically represented in FIG. 1. As can be seen in FIG. 1, the fully carbonized fiber curve (Curve 1) has a very steep slope with respect to the weight % of carbon fiber versus surface resistivity. In contrast, the corresponding slope for the milled fiber curve (Curve 2) has a significantly flatter slope and requires about 50% by weight or more fiber addition to achieve the desired range. As to the present invention's embodiments of partially carbonized chopped fiber curves (Curves 3 and 4), they have about the same slope as the fully carbonized fiber curve (Curve 1), but also level off in the desired range depending on the resistivity and level of carbonization of the fiber (Curve 3 is a carbonaceous chopped fiber with a carbon content of 82%, and Curve 4 is a carbonaceous fiber with a carbon content of 74%) at the same weight % as the fully carbonized fiber curve (Curve 1). Moreover, the partially carbonized chopped fiber curves (Curves 3 and 4) readily achieve the desired surface resistivity while using about one-third less carbon fiber additions than those used for the milled fiber curve (Curve 2).

The moderately conductive, partially carbonized, chopped, linear carbonaceous fibers used in the present invention are preferably derived from preoxidized polyacrylonitrile (PAN) fibers or pitch fibers. The preferable thermoplastic resins include polycarbonates, polyphenylene oxides, polyphenylene sulfides, PEI, PES, PEEK, polyolefins, polyamides, nylons, and mixtures thereof.

The use of chopped carbonaceous fibers having a carbon content of 70–85% by weight permits the attainment of the desired intermediate resistivity more readily and more reproducibly than compared to the standard type of chopped carbon fibers which contain over 92% by weight of carbon content. The use of chopped carbonaceous fibers having a carbon content of 70–85% by weight is also better than the use of milled carbon fiber having over 92% by weight of carbon content since only about two-thirds of the amount of carbon is required and the dustiness of milled fiber is eliminated. As mentioned earlier, milled carbon fiber requires greater loadings than chopped carbonaceous fibers. Milled carbon fiber requires about 15–20% by weight loading levels while the partially carbonized chopped carbon fiber requires only about 10–12% by weight loading levels to achieve the desired surface resistivity. Furthermore, as mentioned above, milled carbon fiber is undesirable due to its dustiness and potential harm to nearby electrical connections and switches.

Preferably, the chopped carbonaceous linear fibers used in the present invention are 3–6 mm in length, and most preferably, about 6 mm long. The present invention is effective in the range of 8–20% by weight of chopped carbonaceous fibers. It has been found, however, to be advantageous to use these fibers in the range of 10–13% by weight. This is superior to the prior art fibers which require loading levels of about 16–20% by weight to get the same surface resistivities the present invention provides at about 12% by weight loading levels.

A preferred embodiment of the present invention includes chopped carbonaceous fibers which contain a nitrogen content of about 14–18% by weight. Another preferred embodiment of the present invention includes a mixture of the chopped carbonaceous fibers with milled carbon fibers. Another preferred embodiment is a mixture of up to about 10% by weight of the fully carbonized fiber and about 2% or more by weight of the partially carbonized fiber.

It has also been found advantageous to combine about 2–10% by weight of conductive reinforcing carbon fibers (92+% by weight, carbon content) with about 2–10% by weight of the less conductive chopped carbonaceous fibers. In such situations, however, it is usually best to use between 6–10% by weight of the conductive reinforcing chopped carbon (92+% by weight carbon content) fibers. This embodiment provides the advantages of both types of fibers; you have reinforcement properties provided by the more conductive reinforcing fibers and lower loading levels provided by the less conductive carbonaceous fibers all together with a product having a controlled intermediate surface resistivity of $10^4$–$10^{10}$ ohms/square.

The carbonaceous fibers of the present invention may be blended with other synthetic or natural fibers. Examples of other reinforcing and/or conductive fibers which may be used include other carbonaceous or carbon fibers, cotton, wool, polyester, polyolefin, nylon, rayon, asbestos, glass fibers, fibers of silica, silica alumina, potassium titanate, silicon carbide, silicon nitride, boron nitride, boron, acrylic fibers, tetrafluoroethylene fibers, polyamide fibers, vinyl fibers, protein fibers, ceramic fibers such as aluminum silicate, and oxide fibers such as boron oxide, thoria, and zirconia.

Once the fibers or fiber assemblies are produced they can be incorporated into the polymer resin matrix to produce various composite structures in substantially any fabricated form. Generally, the initial form is compounded into plastic pellets which are subsequently injection molded into parts such as chip trays and holders. For example, the fiber/polymer composite material of the present invention may be in the form of a sheet or a three-dimensional shaped article suitable for ultimate use. The fiber/polymer composite material can be advantageously produced by impregnating or coating a based material composed of the carbonaceous fibers with the resin and mixing and kneading the fibers and matrix resin. The operation of impregnation, coating, mixing, and laminating can be carried out by conventional methods. For example, one embodiment of the present invention encompasses a plurality of carbonaceous fibers in filament form, which may be used as a filler material and incorporated into the polymer resin by a conventional extrusion process.

Conductive thermoplastics have a number of advantages over other materials like the expensive, complex, and hard to fabricate metal parts used for static control in electronic applications. First, the conductive thermoplastic parts are simple and usually easier and less costly to fabricate. Second, the finished parts are lighter in weight, easier to handle, and less expensive to ship. Third, they are less prone to dents, chips, and scratches during handling and transportation. Fourth, they usually have more consistent and uniform electrical properties. These and other reasons as detailed herein make conductive thermoplastics the preferred option in electronic component handling.

Straight, linear fibers are advantageous over the prior art because they are more efficient and provide a more uniform and consistent product. For example, the edges and corners of prior art products have erratic and non-uniform electrical properties. In contrast, the edges and corners of the resulting product grid when using the long, straight chopped carbonaceous fibers have more uniform electrical properties because the coverage by the fibers are even. All of the above mentioned problems associated with prior art materials are eliminated by the use of the composites of the present invention.

Following is an example of a couple of preferred embodiments of the present invention and the resulting surface resistivities therefor:

Surface Resistivity was measured with a Voyager S.R. Meter.

EXAMPLE I

Pyon® 16* grade of carbon fiber is blended through a single screen extruder with a nylon 66 resin matrix to form pellets which are then injection molded into test pieces:

Results:

| | A | B | C |
|---|---|---|---|
| Pyon ® 16* (weight %) | 11 | 14 | 17 |
| Surface Resistivity (ohms/square) | $10^6$ – $10^7$ | $10^5$ | $10^5$ |

*Pyon ® 16 is a partially carbonized PAN fiber having a nitrogen content of about 18% by weight, a carbon content of about 82% by weight and a resistivity of about $10^{-2}$ ohm-cm.

The data shows that in the 11% by weight loading level, the fibers remain on the steep part of the surface resistivity/carbon fiber curve. But, at 14% by weight or greater, the surface resistivity levels off.

EXAMPLE II

Pyon® 18** grade of carbon fiber is blended through a single screen extruder with a nylon 66 resin matrix to form pellets which are then injection molded into test pieces:

Results:

| | A | B | C |
|---|---|---|---|
| Pyon ® 18** (weight %) | 11 | 14 | 17 |
| Surface Resistivity ohms/square | $10^8 - 10^9$ | $10^6 - 10^7$ | $10^6 - 10^7$ |

Pyon ® 18** is a partially carbonized PAN fiber having a nitrogen content of about 20% by weight, a carbon content of about 74% by weight and a resistivity of about $10^1$ ohc-cm.

The data show that in the case of Pyon® 18 ($10^1$ ohm-cm) the surface resistivity leveled off at the same percentage addition as with Pyon® 16 except that the surface resistivity was higher with Pyon® 18. In both cases the surface resistivity was easily controlled and the required amount of fiber was about 12% by weight to achieve the desired region of intermediate surface resistivity.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A static control composite for use with electronic circuitry, said composite comprising about 8–20% by weight of conductive partially carbonized chopped linear carbonaceous fibers having a carbon content of about 70–85% by weight and an electrical resistivity of about $10^{-2}$–$10^4$ ohm-cm, the remainder of said composite comprising a thermoplastic resin, wherein said composite has a surface resistivity of about $10^4$–$10^{10}$ ohms/square.

2. The composite according to claim 1, wherein said chopped carbonaceous fibers have a length comprising about 3–6 mm.

3. The composite according to claim 1, wherein said chopped carbonaceous fibers comprise about 10–14% by weight.

4. The composite according to claim 1, wherein said chopped carbonaceous fibers have a carbon content comprising about 74–85% by weight.

5. The composite according to claim 1, wherein said thermoplastic resin comprises a material selected from the group consisting of polycarbonates, polyphenylene oxides, polyphenylene sulfides, polyolefins, polyamides, PEI, PES, PEEK, and mixtures thereof.

6. The composite according to claim 1, wherein said surface resistivity comprises about $10^4$–$10^9$ ohms/square.

7. The composite according to claim 1, further comprising about 2–10% by weight of conductive reinforcing carbon fibers having a carbon content of at least 92% by weight and wherein said conductive chopped carbonaceous fibers comprise about 2–10% by weight.

8. The composite according to claim 1, wherein said chopped carbonaceous fibers further include a nitrogen content comprising about 12–20% by weight.

9. The composite according to claim 1, wherein said chopped carbonaceous fibers are derived from fibers selected from the group consisting of preoxidized polyacrylonitrile and pitch.

10. The composite according to claim 1, further including 2–12% milled carbon fibers.

11. The composite according to claim 10, wherein said milled carbon fibers comprise about 2–12% by weight.

* * * * *